US011793342B1

(12) United States Patent
Hall

(10) Patent No.: US 11,793,342 B1
(45) Date of Patent: Oct. 24, 2023

(54) MODULAR CHRISTMAS TREE ASSEMBLY

(71) Applicant: Hilda Hall, Fayetteville, NC (US)

(72) Inventor: Hilda Hall, Fayetteville, NC (US)

( * ) Notice: Subject to any disclaimer, the term of this patent is extended or adjusted under 35 U.S.C. 154(b) by 0 days.

(21) Appl. No.: 17/845,602

(22) Filed: Jun. 21, 2022

(51) Int. Cl.
*A47G 33/06* (2006.01)
*A47G 33/08* (2006.01)

(52) U.S. Cl.
CPC ..... *A47G 33/06* (2013.01); *A47G 2033/0827* (2013.01)

(58) Field of Classification Search
CPC ..... A47G 2033/0827; A47G 33/06
See application file for complete search history.

(56) References Cited

U.S. PATENT DOCUMENTS

| | | | | |
|---|---|---|---|---|
| 2,188,529 | A * | 1/1940 | Corina | A47G 33/06 362/123 |
| 3,617,732 | A * | 11/1971 | Fisher | F21S 4/10 428/23 |
| 3,970,834 | A * | 7/1976 | Smith | A47G 33/06 362/123 |
| 3,985,924 | A * | 10/1976 | Pritza | F21V 21/13 362/123 |
| 4,675,575 | A | 6/1987 | Smith | |
| 4,855,880 | A * | 8/1989 | Mancusi, Jr. | F21S 4/10 428/19 |
| 5,103,380 | A | 4/1992 | Lindner | |
| 5,280,220 | A | 1/1994 | Carter | |
| D345,430 | S | 3/1994 | Ridgeway | |
| 5,338,585 | A | 8/1994 | Fraus | |
| 6,424,096 | B1 | 7/2002 | Lowe | |
| 6,942,355 | B1 * | 9/2005 | Castiglia | F21V 21/002 362/123 |
| 7,021,785 | B2 | 4/2006 | Rubin | |
| 8,905,771 | B2 * | 12/2014 | Tsai | A47G 33/06 439/214 |
| 9,833,098 | B2 * | 12/2017 | Loomis | F21V 23/045 |
| 10,989,374 | B1 * | 4/2021 | Chen | F21V 23/06 |
| 2001/0030862 | A1 | 10/2001 | Simms | |
| 2007/0041188 | A1 | 2/2007 | Angelos | |
| 2015/0359066 | A1 * | 12/2015 | Loomis | H05B 45/20 362/123 |
| 2021/0007527 | A1 * | 1/2021 | Loomis | A41G 1/005 |

FOREIGN PATENT DOCUMENTS

| | | | | |
|---|---|---|---|---|
| DE | 3914678 | | 11/1990 | |
| WO | WO-2005023062 | A2 * | 3/2005 | A47G 33/06 |

* cited by examiner

*Primary Examiner* — Leah Simone MacChiarolo

(57) ABSTRACT

A modular Christmas tree assembly includes a plurality of poles that is insertable into respective ones of the poles to define an elongated stanchion. A plurality of branches is each coupled to and extends away from a respective one of the poles such that the plurality of poles has the ornamental appearance of a Christmas tree. A plurality light emitters is each disposed on a respective one of the branches wherein to emit light outwardly from the respective branch. A base is provided which has a socket is integrated into the base. The socket insertably receives the elongated stanchion thereby facilitating the stanchion to be vertically oriented. A remote control is in wireless communication with the plurality of light emitters for remotely actuating and de-actuating the light emitters.

8 Claims, 4 Drawing Sheets

MODULAR CHRISTMAS TREE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to Christmas tree devices and more particularly pertains to a new Christmas tree device for celebrating the Christmas holiday. The device includes a plurality of poles that are insertable into each other to define a stanchion, each having a plurality of branches. The device includes a plurality of light emitters that is each integrated into a respective branch. The device includes a remote control that is in wireless communication with the light emitters for remotely controlling the light emitters.

(2) Description of Related Art Including Information Disclosed Under 37 CFR 1.97 and 1.98

The prior art relates to Christmas tree devices including a light string that is arranged into the ornamental appearance of a Christmas tree. The prior art discloses an attachment device to attaching lights to a Christmas tree. The prior art discloses a pliant sheet having garland and light emitters coupled to the pliant sheet for displaying a Christmas ornament. The prior art discloses a variety of remote controlled light emitters.

BRIEF SUMMARY OF THE INVENTION

An embodiment of the disclosure meets the needs presented above by generally comprising a plurality of poles that is insertable into respective ones of the poles to define an elongated stanchion. A plurality of branches is each coupled to and extends away from a respective one of the poles such that the plurality of poles has the ornamental appearance of a Christmas tree. A plurality light emitters is each disposed on a respective one of the branches wherein to emit light outwardly from the respective branch. A base is provided which has a socket is integrated into the base. The socket insertably receives the elongated stanchion thereby facilitating the stanchion to be vertically oriented. A remote control is in wireless communication with the plurality of light emitters for remotely actuating and de-actuating the light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
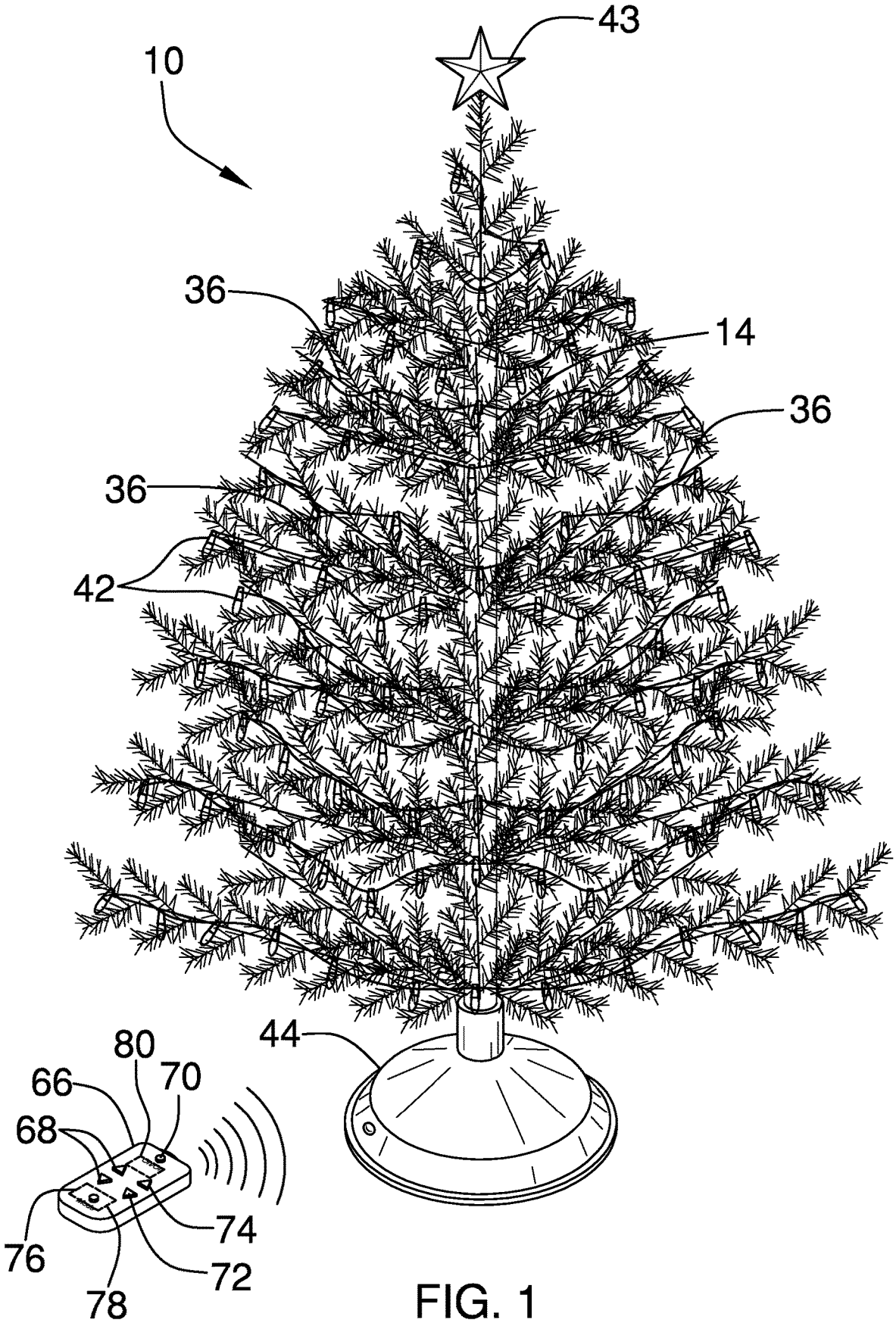
FIG. 1 is a perspective view of a modular Christmas tree assembly according to an embodiment of the disclosure.
Figure 2:
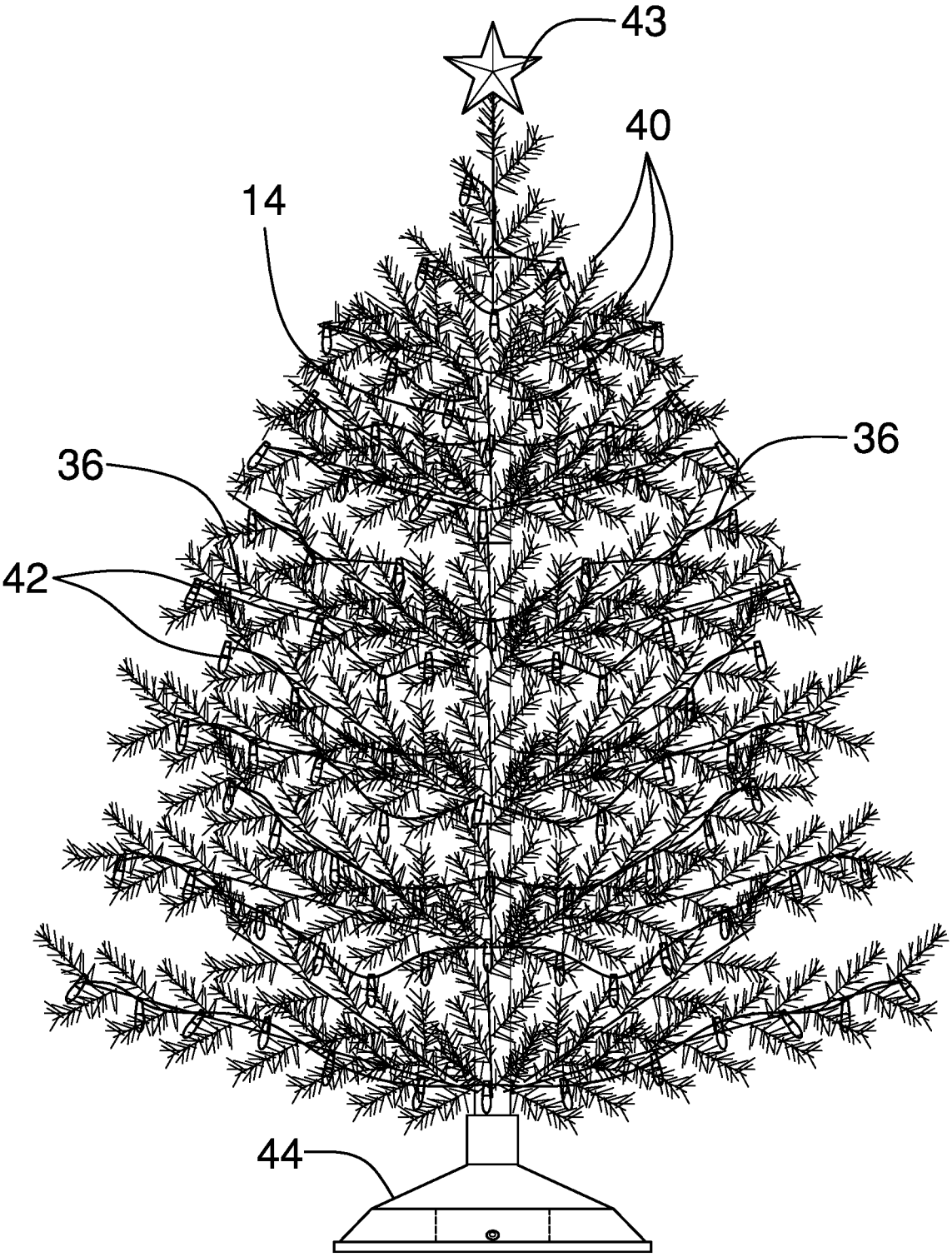
FIG. 2 is a front view of an embodiment of the disclosure.
Figure 3:
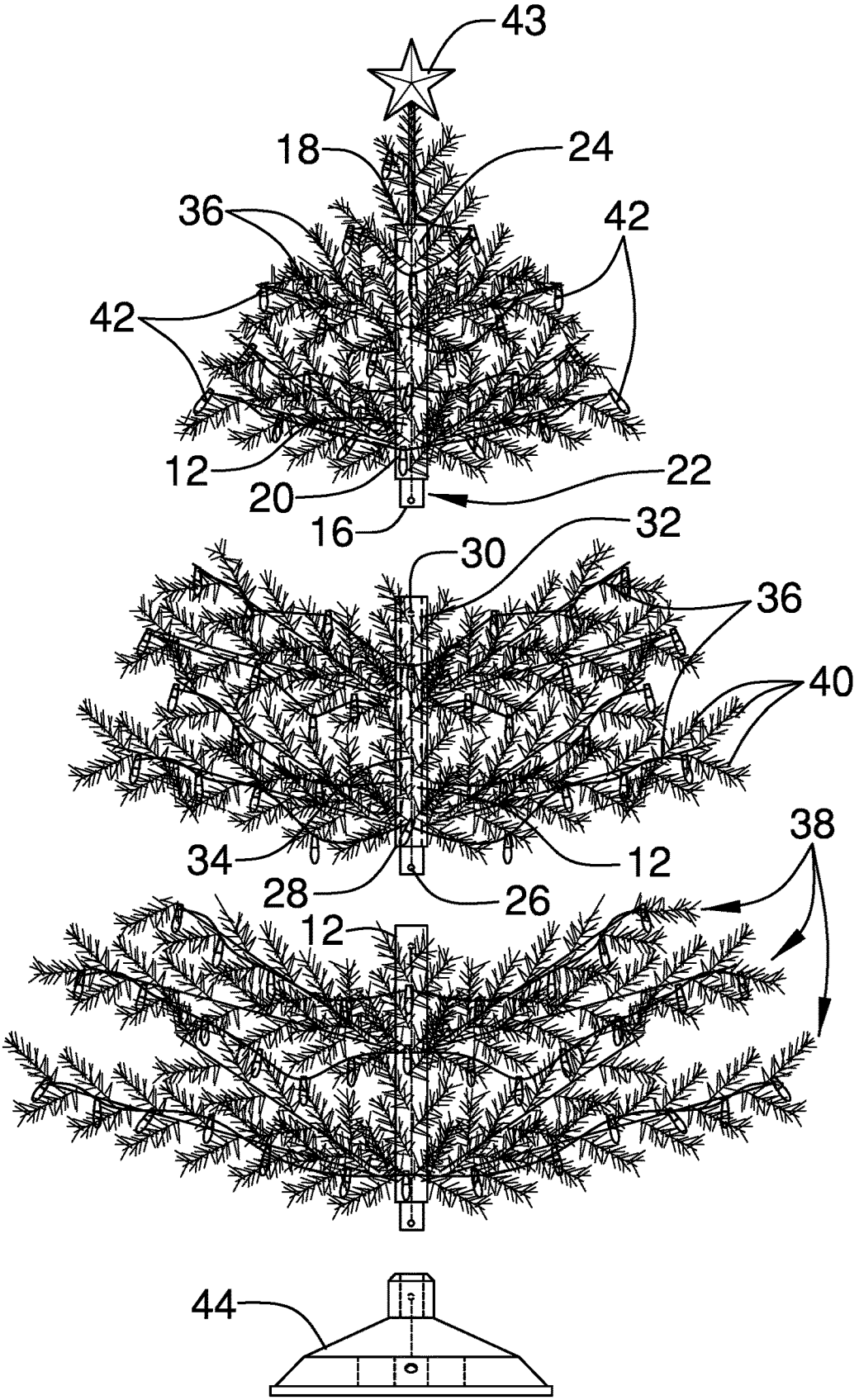
FIG. 3 is a front exploded view of an embodiment of the disclosure.
Figure 4:
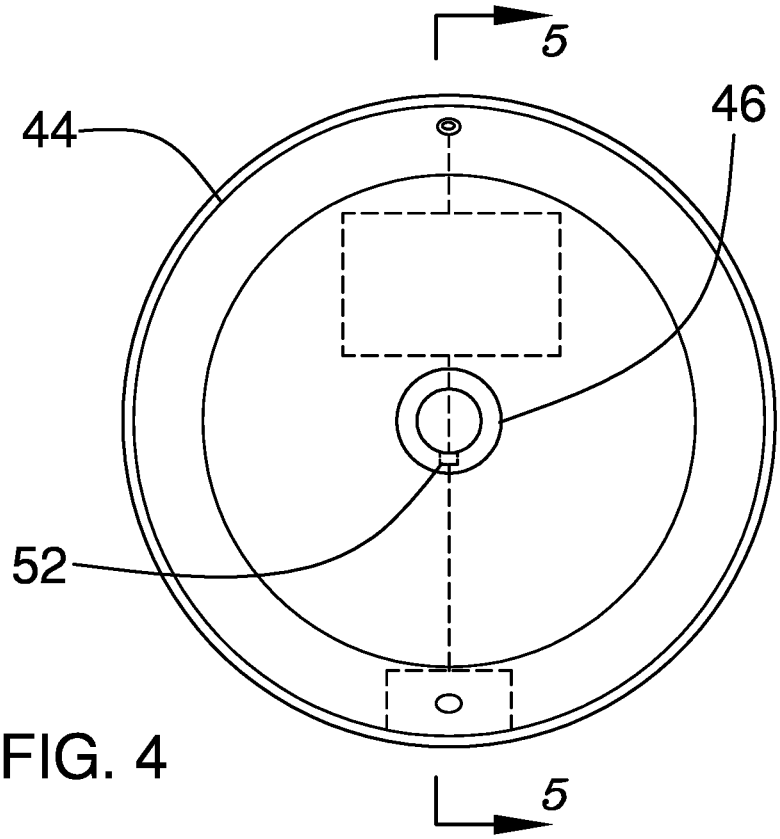
FIG. 4 is a top phantom view of a base of an embodiment of the disclosure.
Figure 5:
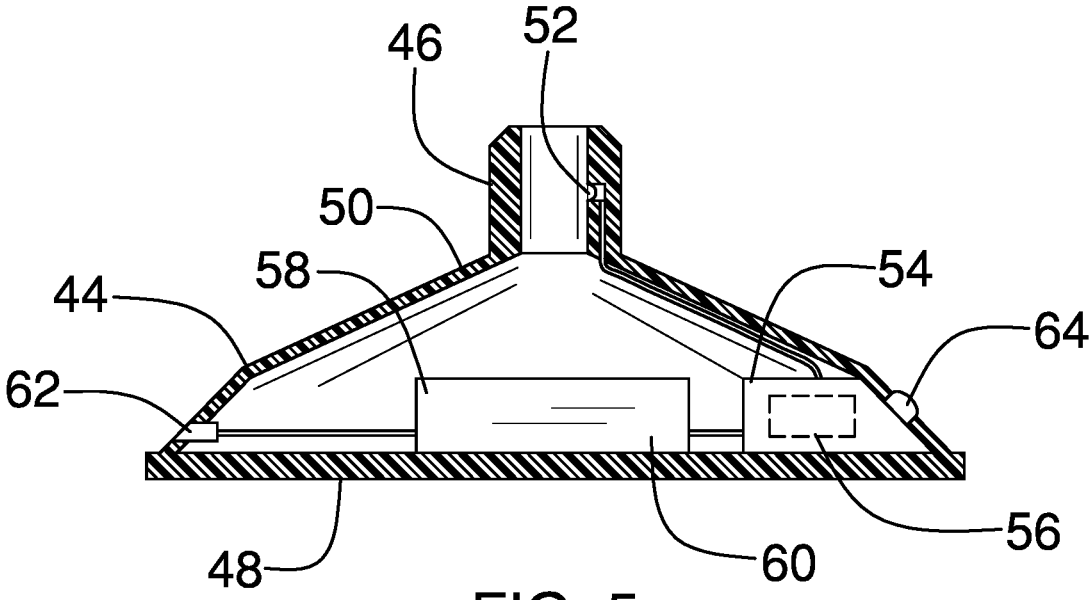
FIG. 5 is a cross sectional view taken along line 5-5 of FIG. 4 of an embodiment of the disclosure.

With reference now to the drawings, and in particular to FIGS. 1 through 5 thereof, a new Christmas tree device embodying the principles and concepts of an embodiment of the disclosure and generally designated by the reference numeral 10 will be described.

As best illustrated in FIGS. 1 through 5, the modular Christmas tree assembly 10 generally comprises a plurality of poles 12 that is each insertable into respective ones of the poles 12 to define an elongated stanchion 14. Each of the poles 12 has a lower end 16, an upper end 18 and an outer wall 20 extending between the lower end 16 and the upper end 18. The outer wall 20 of each of the poles 12 has a first portion 22 which has a diameter that is less than a diameter of a second portion 24, and the first portion 22 extends from the lower end 16 toward the upper end 18. The upper end 18 of each the poles 12 is open such that the upper end 18 of each of the poles 12 insertably receives the first portion 22 of the outer wall 20 of a respective pole 12 having a threshold between the first portion 22 and the second portion 24 of the respective pole 12 abutting the upper end 18 of the pole into which the respective pole 12 is inserted.

Each of the poles 12 has a first contact 26 that is integrated into the outer wall 20 and the first contact 26 in each of the poles 12 is positioned adjacent to the lower end 16. The first contact 26 is positioned on an outer surface 28 of the outer wall 20 and the first contact 26 in each of the poles 12 is comprised of an electrically conductive material. Each of the poles 12 has a second contact 30 that is integrated into the outer wall 20 and the second contact 30 in each of the poles 12 is positioned adjacent to the upper end 18. The second contact 30 is positioned on an inside surface 32 of the outer wall 20 and the second contact 30 in each of the poles 12 is comprised of an electrically conductive material. Additionally, the second contact 30 in each of the poles 12 engages the first contact 26 in a respective one of the poles 12 when the poles 12 are attached together. Each of the poles 12 has a conductor 34 that is integrated into the outer wall 20. Furthermore, the conductor 34 in a respective one of the poles 12 is electrically coupled between the first contact 26 and the second contact 30 in the respective pole 12 such that the first contact 26, the second contact 30 and the conductor 34 in each of the poles 12 forms an electrical circuit.

A plurality of branches 36 is each coupled to and extends away from a respective one of the poles 12. In this way the plurality of poles 12 have the ornamental appearance of a Christmas tree when the poles 12 are inserted into each other to form the elongated stanchion 14. The branches 36 are distributed around a full circumference of the outer wall 20 of the respective pole 12. The branches 36 are arranged in a plurality of sets of branches 38 that are spaced apart from each other and are distributed between the lower end 16 and the upper end 18 of the respective pole 12. Each of the branches 36 has a sequentially decreasing length along a vertical axis of the elongated stanchion 14 when the poles 12 are attached together. The branches 36 include a plurality of needles 40 each extending away from the branches 36 such that the branches 36 have the appearance of pine boughs.

A plurality light emitters 42 is each disposed on a respective one of the branches 36 to emit light outwardly from the respective branch 36. Each of the light emitters 42 on each of the branches 36 on each of the poles 12 is in communication with each other when the poles 12 are attached together to form the elongated stanchion 14. In this way the plurality of light emitters 42 enhance the ornamental appearance of the Christmas tree. Each of the light emitters 42 is electrically coupled to the conductor 34 in the pole 12 to which the respective branch 36 is coupled. Moreover, the light emitters 42 are strategically positioned on the respective branch 36 to enhance visibility of the light emitters 42. Each of the light emitters 42 may comprise a light emitting diode or the like that is capable of emitting light in a variety of different colors. An ornament 43 may be coupled to and extending upwardly from the upper end 18 of a respective one of the poles 12. The ornament 43 may comprise a star or other type of ornament that is typically employed on top of a Christmas tree.

A base 44 is provided that has a socket 46 which is integrated into the base 44. The socket 46 insertably receives the elongated stanchion 14 thereby facilitating the elongated stanchion 14 to be vertically oriented. The base 44 has a bottom side 48 and a top side 50, and the base 44 tapers between the bottom side 48 and the top side 50. The socket 46 extends upwardly from the top side 50. The socket 46 has a primary contact 52 that is integrated into the socket 46. The primary contact 52 is comprised of an electrically conductive material and the primary contact 52 is in electrical communication with the first contact 26 in a respective one of the poles 12 when the elongated stanchion 14 is inserted into the socket 46.

A control circuit 54 is integrated into the base 44 and the control circuit 54 is electrically coupled to the primary contact 52 such that the control circuit 54 is in electrical communication with each of the plurality of light emitters 42 when the elongated stanchion 14 is inserted into the socket 46. The control circuit 54 receives a blink input and the control circuit 54 actuates the light emitters 42 into a blinking condition having the light emitters 42 being alternatively turned on and off when the control circuit 54 receives the blink input. The control circuit 54 receives a pattern input and the control circuit 54 actuates the light emitters 42 into a pattern condition having the light emitters 42 being turned on and off in a pre-determined sequence when the control circuit 54 receives the pattern input.

A receiver 56 is integrated into the base 44 and the receiver 56 is electrically coupled to the control circuit 54. The receiver 56 comprises a radio frequency receiver or the like and the receiver 56 may employ Bluetooth communication protocols. A power supply 58 is integrated into the base 44 and the power supply 58 is electrically coupled to the control circuit 54. The power supply 58 comprises a rechargeable battery 60 that is positioned within the base 44 and the rechargeable battery 60 is electrically coupled to the control circuit 54. The power supply 58 includes a charge port 62 recessed into the base 44 which can receive a plug from a charger. Additionally, the charge port 62 is electrically coupled to the rechargeable battery 60 for charging the rechargeable battery 60. Additionally, the power supply 58 includes a power switch 64 movably integrated into the base 44 and the power switch 64 is electrically coupled to the control circuit 54 for turning the control circuit 54 on and off.

A remote control 66 is in wireless communication with the plurality of light emitters 42 for remotely actuating and de-actuating the light emitters 42. The remote control 66 includes a plurality of control buttons 68 that is each movably integrated into the remote control 66. The plurality of control buttons 68 includes a power button 70, a blink button 72 and a pattern button 74. A remote power supply 76 is positioned in the remote control 66 and the remote power supply 76 comprises at least one battery 78. The remote control 66 might include buttons to adjust the duration of time of the blinking light emitters 42 and to select a variety of pre-determined patterns.

A transmitter 80 is provided and the transmitter 80 is integrated into the remote control 66. The transmitter 80 is electrically coupled to each of the control buttons 68 and the remote power supply 76 is electrically coupled to the transmitter 80. The transmitter 80 is in wireless communication with the receiver 56 and the transmitter 80 broadcasts a blink command to the receiver 56 when the blink button 72 is depressed. Furthermore, the control circuit 54 receives the blink input when the receiver 56 receives the blink command. The transmitter 80 broadcasts a pattern command to the receiver 56 when the pattern button 74 is depressed and the control circuit 54 receives the pattern input when the receiver 56 receives the pattern command. Additionally, the transmitter 80 may comprise a radio frequency transmitter or the like and the transmitter 80 may employ Bluetooth communication protocols.

In use, the poles 12 are attached together to form the elongated stanchion 14 and the elongated stanchion 14 is inserted into the socket 46 on the base 44. In this way the light emitters 42 are electrically coupled to the power supply and the receiver 56. The remote control 66 is manipulated to turn the light emitters 42 on and off and to actuate the blinking condition or the pattern condition. In this way the light emitters 42 can be remotely controlled to adjust the overall appearance of the Christmas tree.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular Christmas tree assembly being programmable to emit light in a variety of patterns and colors, said assembly comprising:

a plurality of poles, said plurality of poles being insertable into respective ones of said poles to define an elongated stanchion;

a plurality of branches, each of said branches being coupled to and extending away from a respective one of said poles wherein said plurality of poles is configured to have the ornamental appearance of a Christmas tree when said poles are inserted into each other to form said elongated stanchion;

a plurality light emitters, each of said light emitters being disposed on a respective one of said branches wherein each of said light emitters is configured to emit light outwardly from said respective branch, each of said light emitters on each of said branches on each of said poles being in communication with each other when said poles are attached together to form said elongated stanchion wherein said plurality of light emitters is configured to enhance the ornamental appearance of the Christmas tree;

a base having a socket being integrated into said base, said socket insertably receiving said elongated stanchion thereby facilitating said stanchion to be vertically oriented;

a remote control being in wireless communication with said plurality of light emitters for remotely actuating and de-actuating said light emitters;

wherein each of said poles has a lower end, an upper end and an outer wall extending between said lower end and said upper end, said outer wall of each of said poles having a first portion having a diameter being less than a diameter of a second portion, said first portion extending from said lower end toward said upper end, said upper end of each said poles being open such that said upper end of each of said poles insertably receives said first portion of said outer wall of a respective pole having a threshold between said first portion and said second portion of said respective pole abutting said upper end of said pole into which said respective pole is inserted;

wherein each of said poles has a first contact being integrated into said outer wall, said first contact in each of said poles being positioned adjacent to said lower end, said first contact being positioned on and facing laterally outward from an outer surface of said outer wall, said first contact in each of said poles being comprised of an electrically conductive material;

wherein each of said poles has a second contact being integrated into said outer wall, said second contact in each of said poles being positioned adjacent to said upper end, said second contact being positioned on and facing laterally inward from an inside surface of said outer wall, said second contact in each of said poles being comprised of an electrically conductive material, said second contact in each of said poles engaging said first contact in a respective one of said poles when said poles are attached together; and wherein each of said poles has a conductor being integrated into said outer wall, said conductor in a respective one of said poles being electrically coupled between said first contact and said second contact in said respective pole such that said first contact, said second contact and said conductor in each of said poles forms an electrical circuit.

2. The assembly according to claim 1, wherein said branches are distributed around a full circumference of said outer wall of said respective pole, said branches being arranged in a plurality of sets of branches being spaced apart from each other and being distributed between said lower end and said upper end of said respective pole, each of said branches having a sequentially decreasing length along a vertical axis of said elongated stanchion when said poles are attached together.

3. The assembly according to claim 1, wherein each of said light emitters is electrically coupled to said conductor in said pole to which said respective branch is coupled.

4. The assembly according to claim 1, wherein said base has a bottom side and a top side, said base tapering between said bottom side and said top side, said socket extending upwardly from said top side, said socket having a primary contact being integrated into said socket, said primary contact being comprised of an electrically conductive material, said primary contact being in electrical communication with said first contact in a respective one of said poles when said elongated stanchion is inserted into said socket.

5. The assembly according to claim 4, further comprising:

a control circuit being integrated into said base, said control circuit being electrically coupled to said primary contact such that said control circuit is in electrical communication with each of said plurality of light emitters when said elongated stanchion is inserted into said socket, said control circuit receiving a blink input, said control circuit actuating said light emitters into a blinking condition having said light emitters being alternatively being turned on and off when said control circuit receives said blink input, said control circuit receiving a pattern input, said control circuit actuating said light emitters into a pattern condition having said light emitters being turned on and off in a pre-determined sequence when said control circuit receives said pattern input; and a receiver being integrated into said base, said receiver being electrically coupled to said control circuit.

6. The assembly according to claim 5, further comprising a power supply being integrated into said base, said power supply being electrically coupled to said control circuit, said power supply comprising:

a rechargeable battery being positioned within said base, said rechargeable battery being electrically coupled to said control circuit;

a charge port being recessed into said base wherein said charge port is configured to receive a plug from a charger, said charge port being electrically coupled to said rechargeable battery for charging said rechargeable battery; and a power switch being movably integrated into said base, said power switch being electrically coupled to said control circuit for turning said control circuit on and off.

7. The assembly according to claim 5, wherein said remote control includes:

a plurality of control buttons, each of said control buttons being movably integrated into said remote control wherein each of said control buttons is configured to be manipulated, said plurality of control buttons including a power button, a blink button and a pattern button;

a transmitter being integrated into said remote control, said transmitter being electrically coupled to each of said control buttons, said transmitter being in wireless communication with said receiver, said transmitter broadcasting a blink command to said receiver when said blink button is depressed, said control circuit receiving said blink input when said receiver receives said blink command, said transmitter broadcasting a pattern command to said receiver when said pattern button is depressed, said control circuit receiving said pattern input when said receiver receives said pattern command; and a remote power supply being positioned in said remote control, said remote power supply being electrically coupled to said transmitter, said remote power supply comprising at least one battery.

8. A modular Christmas tree assembly being programmable to emit light in a variety of patterns and colors, said assembly comprising:

a plurality of poles, said plurality of poles being insertable into respective ones of said poles to define an elongated stanchion, each of said poles having a lower end, an upper end and an outer wall extending between said lower end and said upper end, said outer wall of each of said poles having a first portion having a diameter being less than a diameter of a second portion, said first portion extending from said lower end toward said upper end, said upper end of each said poles being open such that said upper end of each of said poles insertably receives said first portion of said outer wall of a respective pole having a threshold between said first portion and said second portion of said respective pole abutting said upper end of said pole into which said respective pole is inserted, each of said poles having a first contact being integrated into said outer wall, said first contact in each of said poles being positioned adjacent to said lower end, said first contact being positioned on and facing laterally outward from an outer surface of said outer watt, said first contact in each of said poles being comprised of an electrically conductive material, each of said poles having a second contact being integrated into said outer wall, said second contact in each of said poles being positioned adjacent to said upper end, said second contact being positioned on and facing laterally inward from an inside surface of said outer wall, said second contact in each of said poles being comprised of an electrically conductive material, said second contact in each of said poles engaging said first contact in a respective one of said poles when said poles are attached together, each of said poles having a conductor being integrated into said outer wall, said conductor in a respective one of said poles being electrically coupled between said first contact and said second contact in said respective pole such that said first contact, said second contact and said conductor in each of said poles forms an electrical circuit;

a plurality of branches, each of said branches being coupled to and extending away from a respective one of said poles wherein said plurality of poles is configured to have the ornamental appearance of a Christmas tree when said poles are inserted into each other to form said elongated stanchion, said branches being distributed around a full circumference of said outer wall of said respective pole, said branches being arranged in a plurality of sets of branches being spaced apart from each other and being distributed between said lower end and said upper end of said respective pole, each of said branches having a sequentially decreasing length along a vertical axis of said elongated stanchion when said poles are attached together;

a plurality light emitters, each of said light emitters being disposed on a respective one of said branches wherein each of said light emitters is configured to emit light outwardly from said respective branch, each of said light emitters on each of said branches on each of said poles being in communication with each other when said poles are attached together to form said elongated stanchion wherein said plurality of light emitters is configured to enhance the ornamental appearance of the Christmas tree, each of said light emitters being electrically coupled to said conductor in said pole to which said respective branch is coupled;

a base having a socket being integrated into said base, said socket insertably receiving said elongated stanchion thereby facilitating said stanchion to be vertically oriented, said base having a bottom side and a top side, said base tapering between said bottom side and said top side, said socket extending upwardly from said top side, said socket having a primary contact being integrated into said socket, said primary contact being comprised of an electrically conductive material, said primary contact being in electrical communication with said first contact in a respective one of said poles when said elongated stanchion is inserted into said socket;

a control circuit being integrated into said base, said control circuit being electrically coupled to said primary contact such that said control circuit is in electrical communication with each of said plurality of light emitters when said elongated stanchion is inserted into said socket, said control circuit receiving a blink input, said control circuit actuating said light emitters into a blinking condition having said light emitters being alternatively being turned on and off when said control circuit receives said blink input, said control circuit receiving a pattern input, said control circuit actuating said light emitters into a pattern condition having said light emitters being turned on and off in a pre-determined sequence when said control circuit receives said pattern input;

a receiver being integrated into said base, said receiver being electrically coupled to said control circuit;

a power supply being integrated into said base, said power supply being electrically coupled to said control circuit, said power supply comprising:

a rechargeable battery being positioned within said base, said rechargeable battery being electrically coupled to said control circuit;

a charge port being recessed into said base wherein said charge port is configured to receive a plug from a charger, said charge port being electrically coupled to said rechargeable battery for charging said rechargeable battery; and a power switch being movably integrated into said base, said power switch being electrically coupled to said control circuit for turning said control circuit on and off; and a remote control being in wireless communication with said plurality of light emitters tor remotely actuating and de-actuating said light emitters, said remote control including:

a plurality of control buttons, each of said control buttons being movably integrated into said remote control wherein each of said control buttons is configured to be manipulated, said plurality of control buttons including a power button, a blink button and a pattern button;

a transmitter being integrated into said remote control, said transmitter being electrically coupled to each of said control buttons, said transmitter being in wireless communication with said receiver, said transmitter broadcasting a blink command to said receiver when said blink button is depressed, said control circuit receiving said blink input when said receiver receives said blink command, said transmitter broadcasting a pattern command to said receiver when said pattern button is depressed, said control circuit receiving said pattern input when said receiver receives said pattern command; and a remote power supply being positioned in said remote control, said remote power supply being electrically coupled to said transmitter, said remote power supply comprising at least one battery.

* * * * *